US008616276B2

(12) United States Patent
Tips et al.

(10) Patent No.: US 8,616,276 B2
(45) Date of Patent: Dec. 31, 2013

(54) REMOTELY ACTIVATED DOWNHOLE APPARATUS AND METHODS

(75) Inventors: Timothy Rather Tips, Montgomery, TX (US); James R. Longbottom, Magnolia, TX (US); Ricky Layne Covington, Frisco, TX (US); Michael Fripp, Carrollton, TX (US); Lonnie Helms, Duncan, OK (US); Frank Acosta, Duncan, OK (US); Nicholas Budler, Marlow, OK (US); John Key, Comanche, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 226 days.

(21) Appl. No.: 13/179,762

(22) Filed: Jul. 11, 2011

(65) Prior Publication Data

US 2013/0014959 A1 Jan. 17, 2013

(51) Int. Cl.
*E21B 33/12* (2006.01)

(52) U.S. Cl.
USPC ..... 166/250.15; 166/387; 166/120

(58) Field of Classification Search
USPC ..... 166/250.15, 387, 120, 180, 193
See application file for complete search history.

(56) References Cited

U.S. PATENT DOCUMENTS

| | | | | |
|---|---|---|---|---|
| 3,264,994 | A * | 8/1966 | Leutwyler | 102/206 |
| 6,333,699 | B1 | 12/2001 | Zierolf | |
| 6,536,524 | B1 | 3/2003 | Snider | |
| 6,759,968 | B2 | 7/2004 | Zierolf | |
| 6,802,373 | B2 | 10/2004 | Dillenbeck et al. | |
| 7,063,148 | B2 | 6/2006 | Jabusch | |
| 7,665,537 | B2 * | 2/2010 | Patel et al. | 166/387 |
| 7,714,741 | B2 | 5/2010 | Snider et al. | |
| 7,793,733 | B2 | 9/2010 | Stewart | |
| 8,167,032 | B2 * | 5/2012 | Lumbye et al. | 166/187 |
| 2003/0019622 | A1 | 1/2003 | Goodson et al. | |
| 2003/0029611 | A1 | 2/2003 | Owens | |
| 2003/0213595 | A1 | 11/2003 | Jackson | |
| 2008/0110643 | A1 | 5/2008 | Richard et al. | |
| 2009/0008088 | A1 | 1/2009 | Schultz et al. | |
| 2009/0090502 | A1 | 4/2009 | Lumbye et al. | |
| 2009/0223663 | A1 | 9/2009 | Snider et al. | |
| 2009/0223670 | A1 | 9/2009 | Snider | |
| 2010/0243269 | A1 | 9/2010 | Solhaug et al. | |
| 2013/0014971 | A1 * | 1/2013 | Muto et al. | 174/110 SR |

FOREIGN PATENT DOCUMENTS

WO 2007008351 A1 1/2007

OTHER PUBLICATIONS

Petrowell Brochure, RFID Operated FRAC Sleeve, not dated.
Fraley et al., RFID Technology for Downhole Well Applications, Exploration & Production—Oil & Gas Review, 2007.
International Search Report and Written Opinion for PCT/US2012/044032 dated Sep. 16, 2013.
International Search Report and Written Opinion for PCT/US2012/043934 dated Sep. 16, 2013.

* cited by examiner

*Primary Examiner* — William P Neuder
(74) *Attorney, Agent, or Firm* — John W. Wustenberg; McDermott Will & Emery LLP

(57) ABSTRACT

An apparatus includes an impervious body, a sealing element, an energy source, and a trigger. The impervious body is configured to prevent passage of fluid therethrough. The sealing element is disposed about the impervious body. The energy source is operationally connected to the sealing element. The trigger is configured to transfer energy from the energy source to the sealing element. The trigger is activated, at least in part, by receiving a signal transmitted through the impervious body.

17 Claims, 2 Drawing Sheets

100
108
122
120
102
112
110
114
116
106
104
124
130
134
132
126
128
118

REMOTELY ACTIVATED DOWNHOLE APPARATUS AND METHODS

CROSS-REFERENCE TO RELATED APPLICATIONS

The present invention is related to co-pending U.S. application Ser. No. 13/179,833 entitled "REMOTELY ACTIVATED DOWNHOLE APPARATUS AND METHODS," filed concurrently herewith, the entire disclosure of which is hereby incorporated by reference.

BACKGROUND

The present invention relates to downhole apparatus and methods. More particularly the present invention relates to remote setting of a sealing element in a downhole apparatus.

Some packoff devices allow signals to pass through the casing, but most include a hole in the casing to pump tubing pressure into a setting chamber to set the packoff or operate the device. Even when holes are not provided for pressure reasons, a hole may be required to allow for an electronic feedthrough, which provides a potential leakage path between an interior and an exterior of the casing. Such hole may be drilled through the casing and machined with or without a thread. The thickness of the casing wall precludes an effective metal to metal seal to be used or designed. Such hole in the casing may be undesirable as it may connect to a sealed chamber using elastomeric and/or thermoplastic seals on the outside of the casing. If these seals become compromised, then a potentially very consequential leak from the interior of the casing to the annulus may occur.

SUMMARY OF THE INVENTION

The present invention relates to downhole apparatus and methods. More particularly the present invention relates to remote setting of a sealing element in a downhole apparatus.

In one embodiment, an apparatus includes an impervious body, a sealing element, an energy source, and a trigger. The impervious body is configured to prevent passage of fluid therethrough. The sealing element is disposed about the impervious body. The energy source is operationally connected to the sealing element. The trigger is configured to transfer energy from the energy source to the sealing element. The trigger is activated, at least in part, by receiving a signal transmitted through the impervious body.

In one embodiment, an apparatus includes an impervious body, a sealing element, a hydraulic fluid reservoir, an electronics compartment, a pressure barrier, and a trigger. The impervious body is configured to prevent passage of fluid therethrough. The sealing element is disposed about the impervious body. The hydraulic fluid reservoir is operationally connected to the sealing element. The electronics compartment is hydraulically connected to the hydraulic fluid reservoir. The pressure barrier is between the hydraulic fluid reservoir and the electronics compartment. The trigger is configured to receive a signal from within an interior of the impervious body and open the pressure barrier. Opening of the pressure barrier permits movement of hydraulic fluid out of the hydraulic fluid reservoir and into the electronics compartment, allowing the sealing element to set.

In one embodiment a method includes providing an apparatus, introducing the apparatus into a wellbore, and providing a signal to a trigger through an impervious body of the apparatus, thereby causing a sealing element to set. The apparatus includes an impervious body, a sealing element, an energy source, and a trigger. The impervious body is configured to prevent passage of fluid therethrough. The sealing element is disposed about the impervious body. The energy source is operationally connected to the sealing element. The trigger is configured to transfer energy from the energy source to the sealing element. The trigger is activated, at least in part, by receiving a signal transmitted through the impervious body.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to downhole apparatus and methods. More particularly the present invention relates to remote setting of a sealing element in a downhole apparatus.

Of the many advantages of the present invention, only a few of which are discussed or alluded to herein, the present invention provides a packoff device for isolation of an annular space in a wellbore to help prevent migration of gas and other formation fluids through a cement column and to the surface. A secondary annular barrier set in the previous casing may provide an immediate annular barrier for the period of time in which the cement sets to help prevent the flow of fluids or gas through the unset cement. Additionally, a secondary annular barrier may provide a mechanical seal in the event of contamination of the cement by formation fluids resulting in a channel or flow path through the cement sheath. Thus, an annular packer seal may be remotely activated without holes through the casing. In other words, there may be no hydraulic communication path between the inside of the casing and the annular space. Generally, the seal assembly may receive a signal from the surface or from another remote triggering mechanism. The signal may be decoded and the energy stored within the seal assembly may be used to set the seal.

To facilitate a better understanding of the present invention, the following examples are given. In no way should the following examples be read to limit, or to define, the scope of the invention.

Figures 1A, 1B:
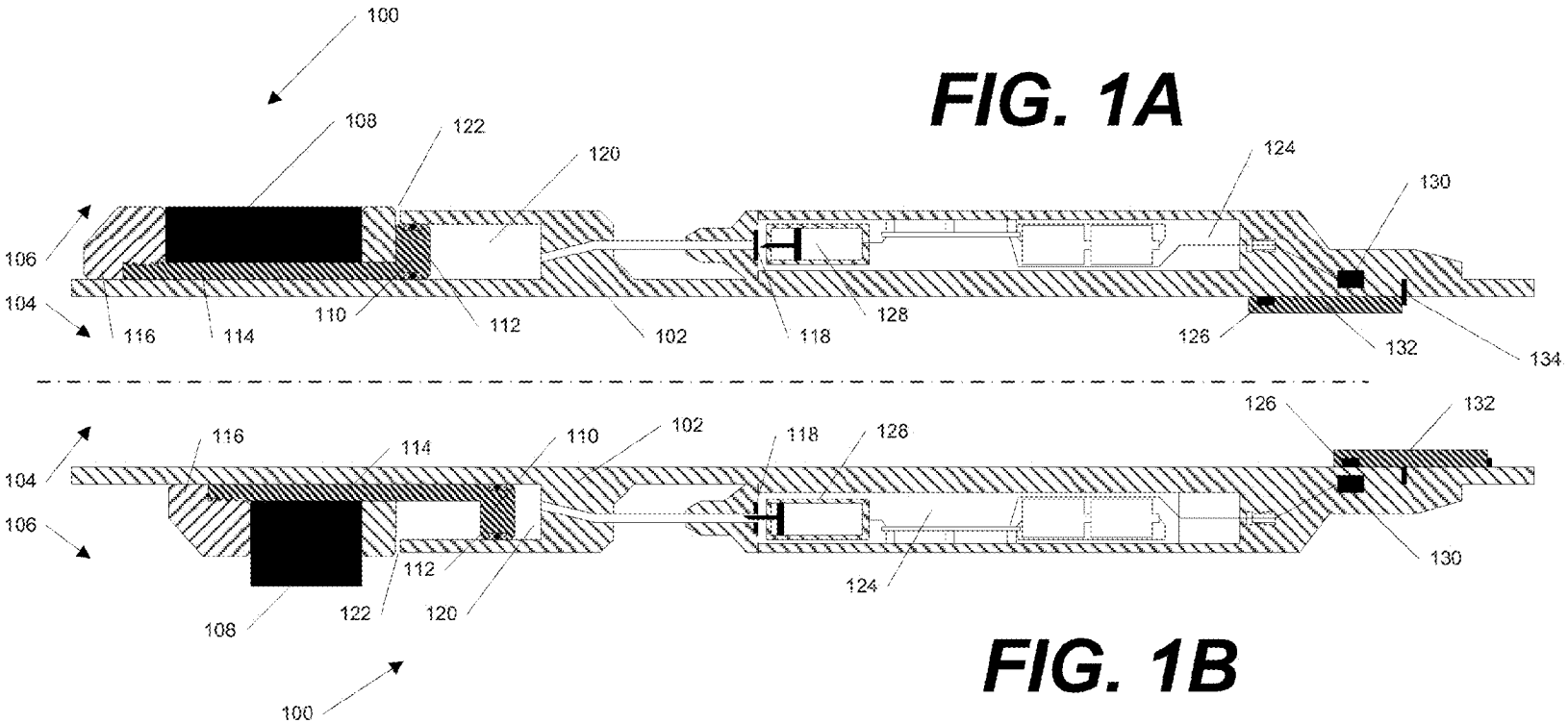
FIG. 1A illustrates one embodiment of an apparatus, in a run-in configuration, in accordance with the present disclosure.
FIG. 1B illustrates the apparatus of FIG. 1A, in a set configuration, in accordance with the present disclosure.

Referring now to FIGS. 1A and 1B, an exemplary apparatus 100 may be a packer, swell packer, casing annulus isolation tool, stage cementing tool, or any other downhole tool. Apparatus 100 may have impervious body 102 disposed between interior 104 and exterior 106 of apparatus 100. Impervious body 102 may be substantially solid, providing a barrier between interior 104 and exterior 106. Sealing element 108 may be disposed about impervious body 102. A signal may be transmitted through impervious body 102, e.g., from interior 104 of impervious body 102 to a trigger either in or exterior to impervious body 102. The trigger may be configured to transfer energy from an energy source to sealing element 108, causing sealing element 108 to set, or to otherwise seal against a casing wall.

Impervious body 102 may include one or more joints of casing, having metal-to-metal threaded connections or otherwise threadedly joined to form a tubing string, or impervious body 102 may form a portion of a coiled tubing. Impervious body 102 may be partially or wholly formed of any of a number of materials, including, but not limited to, substantially non-magnetic or non-ferrous materials such as Inconel, Incoloy, steel, and K-Monel, allowing for effective magnetic communication therethrough. In some embodiments, only a portion of impervious body 102 is constructed of a substantially non-magnetic material. More particularly, a portion of impervious body 102 proximate magnetic signaling elements and/or magnetic switches may be substantially non-magnetic, while the remainder of impervious body 102 may be constructed otherwise. In some embodiments, even the portion proximate the magnetic actuators may be magnetic, so long as the magnetic signaling elements and switches, or other signaling elements or switches can still be actuated. Impervious body 102 may have a generally cylindrical tubular shape, with an interior surface and an exterior surface having substantially concentric and circular cross-sections. However, other configurations may be suitable, depending on particular conditions and circumstances. For example, some configurations may include offset bores, sidepockets, etc.

Impervious body 102 may be solid. Stated otherwise, impervious body 102 may lack holes or other passages between interior 104 and exterior 106. While impervious body 102 may have passages between various portions thereof, impervious body 102 does not include passageways extending the full distance between interior 104 and exterior 106. Thus, fluids or other materials, cannot pass from interior 104 to exterior 106 through impervious body 102. Rather, fluids must pass around ends of impervious body 102 to move from interior 104 to exterior 106, or vice versa. A body with a hole or passage therethrough, like those used for electrical connectors, may provide a leak path. In other words, a leak may form through a drilled hole or passage, even if it has been sealed by a patch or plug. Thus, a body with a hole or passage passing through the body, from an interior to an exterior thereof, would not be considered impervious, and such a body would not be an impervious body.

Impervious body 102 may have any of a number of cross-sectional configurations. For example, impervious body 102 may have portions with a cross-section formed of uniform solid construction, such as a joint of tubing forming a "wall" or other barrier between interior 104 and exterior 106. Impervious body 102 may include portions formed of a non-uniform construction, for example, a joint of tubing having compartments, cavities or other components therein or thereon. Impervious body 102 may be formed of various components, including, but not limited to, a joint of casing, a coupling, a lower shoe, a crossover component, or any other component. Various elements may be joined via metal-to-metal threaded connections, welded, or otherwise joined to form impervious body 102. Such impervious body 102, when formed from casing threads with metal to metal seals, may omit elastomeric or other materials subject to aging, and/or attack by environmental chemicals or conditions. Thus, impervious body 102 may include various elements joined to form a boundary impermeable to downhole fluids.

Sealing element 108 may be disposed about impervious body 102 in a number of ways. For example, sealing element 108 may directly or indirectly contact an exterior surface of impervious body 102. As illustrated in FIGS. 1A and 1B, sealing element 108 may be external to hydrostatic piston 110, which may be external to impervious body 102. Sealing element 108 may include a standard compression set element, similar to those common in conventional cased hole packer design. Alternatively, sealing element 108 may include a compressible slip on a swellable element, a compression set element that partially collapses, a ramped element, a cup-type element, chevron-type seal, inflatable elements, an epoxy or gel squirted into the annulus, or other sealing elements.

Hydrostatic piston 110 may provide energy to set sealing element 108. Hydrostatic piston 110 may be partially housed within a section of impervious body 102. For example, as illustrated in FIGS. 1A and 1B, hydrostatic piston 110 may have piston portion 112 lying within an opening of impervious body 102, with stem portion 114 lying external to impervious body 102. Stern portion 114 may include or attach to block 116 in contact with sealing element 108. Thus, sealing element 108 may be disposed between block 116 of hydrostatic piston 110 and a portion of impervious body 102. Hydrostatic piston 110 may be configured to move in the presence of a predetermined hydrostatic pressure (after rupture disk 118 is open). Movement of hydrostatic piston 110 may cause block 116 to provide force on sealing element 108, while impervious body 102 supports an opposite side of sealing element 108. Thus sealing element 108 may be compressed, as illustrated in FIG. 1B. Piston portion 112 of hydrostatic piston 110 may lie within hydraulic fluid reservoir 120, such that hydraulic pressure on one side of piston portion 112 causes an equalization of pressure on the other side of piston portion 112.

Hydraulic fluid reservoir 120, or other energy source operationally connected to sealing element 108, may be actuated by a trigger, causing sealing element 108 to set. Hydraulic fluid reservoir 120 may be wholly or partially contained in impervious body 102. Hydraulic fluid reservoir 120 may include opening 122 to provide pressure equalization. Hydrostatic piston 110 and associated seals may form an effective boundary of hydraulic fluid reservoir 120, isolating fluid on one side of hydrostatic piston 110 from fluid on the other side of hydrostatic piston 110, while allowing pressure equalization therebetween. Thus, as apparatus 100 is run into the wellbore, hydrostatic pressure may be transmitted through opening 122 in impervious body 102, and act on one side of piston portion 112 of hydrostatic piston 110. Hydraulic or other minimally compressible, substantially non-compressible, or other flowable fluid may be contained within hydraulic fluid reservoir 120, on the other side of piston portion 112 of hydrostatic piston 110 during run-in. Thus, during run-in, the hydrostatic pressure acting on hydrostatic piston 110 may cause little or no movement of hydrostatic piston 110.

Hydraulic fluid reservoir 120 may connect to compartment 124 via, a passage, which may be partially or wholly contained in impervious body 102. Compartment 124 may be a compartment useful for purposes other than evacuation of minimally compressible fluid. For example, compartment 124 may be an electronics compartment or electrical energy storage compartment that may contain electronics, including, but not limited to, primary batteries, secondary batteries, capacitors, and super capacitors. Alternatively, or additionally, compartment 124 may be a chemical energy storage compartment that may contain chemicals, including, but not limited to, pyrotechnic compounds, thermite, and energetic materials. Similarly, compartment 124 may store fluidic components, including, but not limited to, orifices and fluidic diodes. Compartment 124 may be partially or wholly filled with gas or other compressible fluid sealed therein. For example, compartment 124 may contain air at approximately atmospheric pressure prior to entry in the wellbore. Allowing the minimally compressible fluid to evacuate into compartment 124, rather than a dedicated evacuation area, may allow apparatus 100 to have an increased cross-sectional area, particularly when compartment 124 is a compartment already present on apparatus 100.

The passage between hydraulic fluid reservoir 120 and compartment 124 may be any of a number of fluidic connections between hydraulic fluid reservoir 120 and compartment 124. A pressure barrier, such as, but not limited to, rupture disk 118, rupture plate (not shown), and the like may restrict or prohibit flow through the passage. Other configurations for passage and flow restriction may be used, depending on particular circumstances and design variables. Rupture disk 118 may allow for the minimally compressible fluid to be substantially contained within hydraulic fluid reservoir 120 until a triggering event occurs, causing a trigger to receive a signal from within interior 104 of impervious body 102 and resultantly open rupture disk 118. Once rupture disk 118 is open, the minimally compressible fluid within hydraulic fluid reservoir 120 may be free to move out of hydraulic fluid reservoir 120 through rupture disk 118 and into compartment 124.

Thus, when rupture disk 118 is opened, pressure may equalize across piston portion 112 of hydrostatic piston 110. If hydrostatic pressure is greater than the pressure of the minimally compressible fluid and the compressible fluid initially present in compartment 124, piston portion 112 of hydrostatic piston 110 may move. Such movement may evacuate or move some or all of the minimally compressible fluid from hydraulic fluid reservoir 120 through rupture disk 118 and into compartment 124. The movement of hydrostatic piston 110 may also cause compression of sealing element 108, such that sealing element 108 bulges outwardly, until it is set.

Thus, when operating apparatus 100 with hydrostatics, hydraulic fluid reservoir 120 may be kept in balance by self-equalizing the position of piston portion 112 of hydrostatic piston 110 between the minimally compressible fluid in hydraulic fluid reservoir 120 and increasing external hydrostatic pressures while entering the well. Rupture disk 118 may bear the brunt of the hydrostatic loading, allowing for a reduction in wall thickness in areas of hydrostatic piston 110. This may provide for the ability to increase the inner diameter of apparatus 100 within a given outer diameter restriction. In some applications, casing sizes from 18 inches to 4½ inches are viable. For example, casing sizes may include 9⅝ inch casing inside 13⅝ inch casing, or 5½ inch inside 7⅝ inch casing.

Rupture disk 118 may be opened or actuated by a trigger. The trigger may include a signal transmitted from interior 104 of impervious body 102 to cause rupture disk 118 to open and sealing element 108 to set. The trigger may cause rupture disk 118 to open, ultimately resulting in the setting of sealing element 108. The trigger may include any of a number of devices configured to open rupture disk 118. Some or all components of the trigger may be disposed either on exterior 106, or between interior 104 and exterior 106 of impervious body 102. The trigger may receive a signal from signaling element 126, which may be disposed on or within interior 104 of impervious body 102. Some exemplary triggers include, but are not limited to, the following: a strain sensor which senses changes in internal pressure and thus strain in the pipe and an imposed series of internal pressure changes within the pipe; a pressure sensor mounted on the tool to sense pressure changes imposed from the surface; a sonic sensor or hydrophone to sense sound signatures generated at or near the wellhead through the casing and/or fluid; a Hall effect, Giant Magnetoresistive (GMR) or other magnetic field type sensor receiving a signal from a wiper, dart, or other pump tool pumped through interior 104 of apparatus 100; a Hall effect sensor sensing increased metal density caused by a snap ring being shifted into a sensor groove as a wiper plug or other pump tool passes through apparatus 100; Radio Frequency Identification (RFID) signals generated by radio frequency devices pumped in the fluid through apparatus 100; mechanical proximity device sensing change in magnetic field generated by a sensor assembly (e.g., an iron bar passing through a coil as part of a wiper assembly or other pump tool); inductive powered coil passing through apparatus 100 inducing a current in sensors within apparatus 100; acoustic source in a wiper, dart, or other pump tool that may be pumped through the inner diameter of apparatus 100; an ionic sensor that detects the presence of the cement or the cement pad, and a pH sensor that detects pH signals or values.

The trigger may include punch canister 128 in communication with switch 130, thermite to burn a hole (not shown) in rupture disk 118, or any of a number of other devices configured to open the pressure barrier, and allow hydrostatic pressure to cause the sealing element 108 to set.

The signal may include a sound generated proximate a wellhead, and passing through fluid passing through impervious body 102. Alternatively, or additionally, the signal may be a sound generated by a pump tool or other apparatus passing through impervious body 102. The signal may include a modification or transmission of a magnetic signal from a pump tool or other apparatus pumped through impervious body 102, or a modification of a magnetic signal from movement of sleeve 132 disposed within interior 104 of impervious body 102. The signal may be a current induced by an inductive powered device passing through impervious body 102. The signal may be a radio frequency identification signal generated by radio frequency devices pumped with fluid passing through impervious body 102. The signal may be a pressure signal induced from the surface in the well which may then be picked up by pressure transducers or strain gauges mounted on or in impervious body 102. One having ordinary skill in the art will appreciate that a number of other signals would be suitable for transmission from interior 104 of impervious body 102 to trigger the setting of sealing element 108.

In one embodiment, the signal may be transmitted by sleeve 132 moving relative to impervious body 102. Sleeve 132 may be attached to an interior surface of or otherwise disposed in impervious body 102 and configured to detach and move when contacted by a pump tool or other apparatus. Sleeve 132 may contain signaling element 126, such as a magnet, a sound generating device, or a radio frequency generating device. Thus, movement of sleeve 132 relative to impervious body 102 may create a signal to the trigger.

In some embodiments, sleeve 132 may be attached to impervious body 102 via shear pins, or shear rings (e.g., shear ring 134). In such configurations, positive affirmation that sleeve 132 has moved downward an appropriate distance may be provided through simple monitoring of surface pressure increases to the predetermined shear value, followed by a subsequent pressure drop when the pump tool has been released. In other embodiments, sleeve 132 may be attached to impervious body 102 via a c-ring or collet, allowing a pump tool to be dropped into apparatus 100, such that when sleeve 132 shifts downward, the collet or c-ring may fall into a corresponding recess provided in impervious body 102, allowing the pump tool to pass through impervious body 102. In such configurations, the pump tool may not release from the c-ring or collet until the pump tool has fully moved down through impervious body 102.

Referring to FIGS. 1A and 1B, movement of sleeve 132 may cause transmission or modification of a signal from signaling element 126 to switch 130, such that switch 130 causes punch canister 128 to pierce and open rupture disk 118. Thus, when impervious body 102 is formed of non-magnetic material and signaling element 126 includes a magnet, the signal to the trigger may include an indication of magnetic communication between the magnet on sleeve 132 and switch 130, which may be a magnetic switch.

Figure 2A:
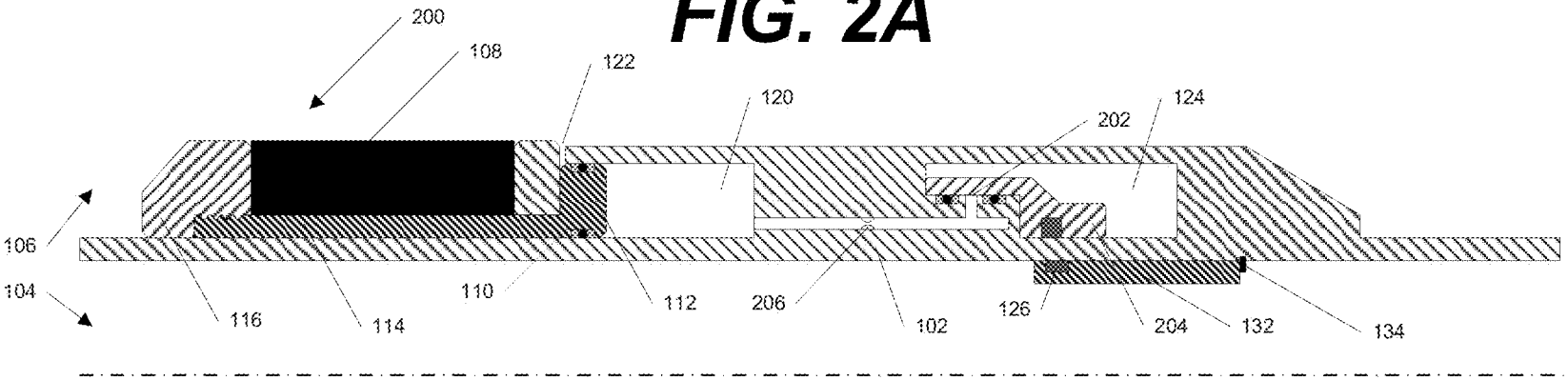
FIG. 2A illustrates another embodiment of an apparatus, in a run-in configuration, in accordance with the present disclosure.
Figure 2B:
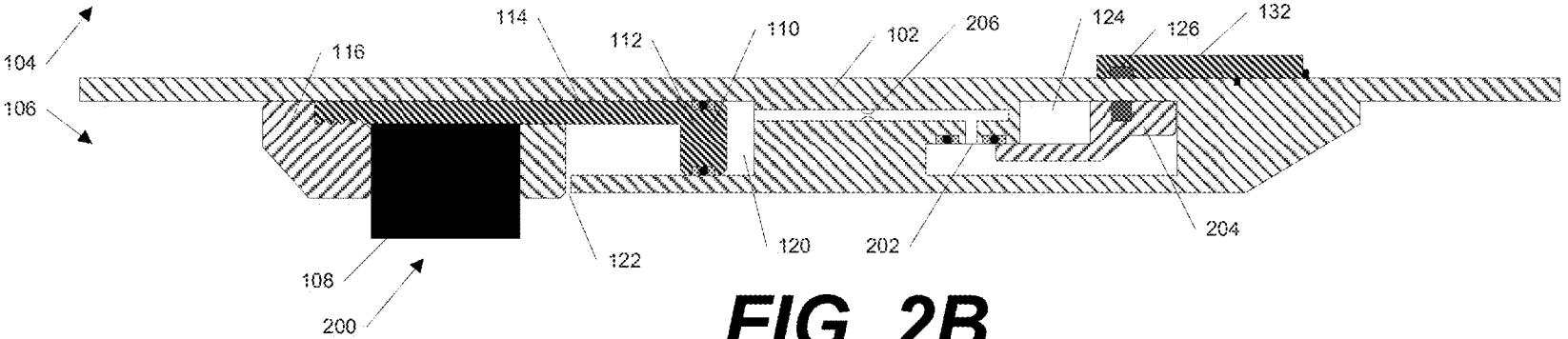
FIG. 2B illustrates the apparatus of FIG. 2A, in a set configuration, in accordance with the present disclosure.

Referring now to FIGS. 2A and 2B, an alternative apparatus 200 may be similar to apparatus 100, with the description above applying equally to apparatus 200. However, rupture disk 118 of apparatus 100 is absent from apparatus 200. Rather, port 202 coupled with shifting sleeve 204 provide selective passage of fluid between hydraulic fluid reservoir 120 and compartment 124. Shifting sleeve 204 may have a port cover thereon, allowing shifting sleeve 204 to cover or block flow from port 202. Like rupture disk 118, port 202 and shifting sleeve 204 may allow for the minimally compressible fluid to be substantially contained within hydraulic fluid reservoir 120 until a triggering event occurs, causing the trigger to receive a signal from within interior 104 of impervious body 102 and resultantly allow port 202 to be uncovered or opened. Once port 202 is uncovered, the minimally compressible fluid within hydraulic fluid reservoir 120 may be free to move out of hydraulic fluid reservoir 120 through open port 202 and into compartment 124. Thus, once port 202 is uncovered, pressure may equalize across piston portion 112 of hydrostatic piston 110. If hydrostatic pressure external to apparatus 100 is greater than the combined pressure of the minimally compressible fluid and the compressible fluid initially present in compartment 124, then piston portion 112 of hydrostatic piston 110 may move to equalize pressure. Such movement may evacuate or move some or all of the minimally compressible fluid from hydraulic fluid reservoir 120 through port 202 and into compartment 124. The movement of hydrostatic piston 110 may also cause compression of sealing element 108, such that sealing element 108 bulges outwardly, until it is set.

As with rupture disk 118, port 202 may be uncovered or opened by a trigger, such as those described above for opening rupture disk 118. Other triggers for opening port 202 may include those that move shifting sleeve 204 away from port 202. Thus, movement of sleeve 132 may cause shifting sleeve 204 to be moved from a first or closed position (FIG. 2A) to a second or open position (FIG. 2B), or vice versa, by magnetic force. Thus, when impervious body 102 is formed of non-magnetic material and signaling element 126 includes a magnet magnetically communicating with the trigger, which is attached to shifting sleeve 204, the signal to the trigger may be movement of the magnet on sleeve 132, which in turn triggers the movement of the corresponding magnet on shifting sleeve 204. In other words, the movement of the first magnet signals the second magnet to move, and uncover or open port 202. Thus, by dropping a pump tool to land on an internal sleeve, an external sleeve (e.g., on the outer diameter of a casing string) can be moved. As with apparatus 100, apparatus 200 may have sleeve 132 attached to interior 104 of impervious body 102 and configured to detach and move when contacted by a pump tool or other apparatus. In some embodiments, it may be desirable to place signaling element 126 on the outer diameter of sleeve 132 and switch 130 or other trigger on the inner diameter of shifting sleeve 204. Thus, the magnets may retain their coupling force between sleeve 132 and shifting sleeve 204, and they may both shift in unison.

In some embodiments, the trigger may receive the signal, wait a predetermined time, and then cause sealing element 108 to set. Alternatively, the passage between hydraulic fluid reservoir 120 and compartment 124 and/or port 202 may have a restriction, such as orifice 206 or other fluidic component, to prevent instantaneous equalization of pressure between hydraulic fluid reservoir 120 and compartment 124. Orifice 206 may instead cause a more controlled equalization of pressure, which may cause sealing element 108 to set more slowly. Orifice 206 may be sized so as to provide the desired setting time. A similar configuration could be used in apparatus 100, as would be appreciated by one having ordinary skill in the art.

Some advantages of apparatus 200 using magnets in sleeve 132 and shifting sleeve 204 include the ability to activate a downhole tool without hydraulic communication between the annulus and the inside of the casing without the need to send an electronic signal. A pump tool can be used to activate apparatus 200, using magnetic coupling force to shift sleeve 132 and shifting sleeve 204 in tandem, to open port 202 or otherwise activate apparatus 200.

Apparatus 200 may be run in hole in run-in position, with shifting sleeve 204 having a port cover portion covering port 202. Magnets on inner diameter of shifting sleeve 204 and outer diameter of sleeve 132 may be aligned and magnetically coupled. Additionally, shear ring 134 may hold sleeve 132 in interior 104 of apparatus 200 in the run-in position. The pump tool may land on sleeve 132. As pressure increases, shear ring 134 may shear and sleeve 132 may move along with the pump tool. As sleeve 132 moves, shifting sleeve 204, which may be magnetically coupled to sleeve 132 may also move. Movement of shifting sleeve 204, in turn, may cause rupture disk 118 to open, allowing hydrostatic pressure to cause movement of hydrostatic piston 110, and thus, compression of sealing element 108, such that the apparatus 200 is set.

Methods of using apparatus 100 or 200 may include providing the apparatus, and introducing the apparatus into a wellbore. Once the apparatus is run into the wellbore to a desired position, a signal may be provided to the trigger. The signal may be provided from within interior 104 of impervious body 102. The signal may activate the trigger and cause sealing element 108 to set. In some embodiments, after the trigger receives the signal, a period of time may elapse before the trigger causes sealing element 108 to set. For example, the trigger may receive the signal, wait a predetermined time, and then cause sealing element 108 to set. Likewise, various minimally compressible fluids, non-compressible fluids, and/or compressible fluids may be used in hydraulic fluid reservoir 120 and/or compartment 124 to control setting time of sealing element 108. This may allow for continued circulation of cement after a plug passes apparatus 100 to allow the plug to reach the bottom of the casing string before the sealing element 108 is set.

In some embodiments, after the apparatus has been run into the wellbore to a desired position, the signal may be provided in the form of introduction of a pump tool into the wellbore. The pump tool may be any tool provided to wipe, separate fluid, provide an indication of pressure, or provide mechanical actuation downhole. Some examples of pump tools include, but are not limited to, plugs, wipers, darts, balls, and short section of fluid with unique properties such as a gelled fluid or magnetic fluid. Pump tools may be constructed of aluminum, composites, rubber, fluids or any other material suitable for downhole use. The pump tool may cause sleeve 132 to move and/or detach or otherwise cause switch 130 to sense or detect a signal. Movement of sleeve 132 may provide the signal to the trigger to set the sealing element 108. Other methods of providing a signal to the trigger include introducing a signal generating device, other than the pump tool, into the wellbore. For example, a robotic tractor device could drop or crawl to location and subsequently crawl out of the wellbore, or a signal generating device may be introduced by other means, such as a wireline. Some signals generated by a signal generating device may include, but are not limited to, transmission or modification of sound, magnetic signal, induced current, vibration, thermal signal, magnetic permeability, dielectric permittivity, radio frequency, and a signal relating to strain. Alternatively, signals may be generated proximate a wellbore or elsewhere, and transmitted from interior 104 of impervious body 102 to the trigger, causing sealing element 108 to set.

In some embodiments, a digital signal may be encoded at the surface and then, in addition to activating sealing element 108, the digital signal could also be used to initiate oilier actions in the apparatus. For example, the received signal could be used to activate sealing element 108, or it could be used to activate a timer that sets sealing element 108 at a later time. The received signal could be a triggering set where the system may be activated for looking for changes in the fluid composition. Such initiation steps may be useful in avoiding false signal detection that could prematurely activate sealing element 108. The initiation steps may also be used to minimize the power consumption of the apparatus. Finally, different signals could be sent so that the apparatus could provide a status update.

For example, the following steps may occur: (1) encode digital signal; (2) transmit signal; (3) receive signal; (4) decode digital signal; and (5) take action. The action of step (5) may include any of the following: (a) activate seal—resulting in mechanical seal setting in annulus; (b) system diagnostic—resulting in depassivate batteries or report status; (c) initiate timer—resulting in seal activated after time delay; or (d) initiate fluid sensor resulting in the fluid sensor detecting cement and activating seal. The decoding electronics generally take the output from the receiver and transform it into a digital signal as follows: receiver—signal conditioner—frequency filter adaptive gain (looping in a frequency filter) adaptive threshold (looping in a frequency filter)—comparator—digital signal. The adaptive gains and the adaptive threshold may be used to minimize the sensitivity to downhole noise conditions.

In one embodiment, magnets in the cement plug create a changing magnetic flux by the receiver. A series of alternating magnets (e.g., uniquely keyed polarity and spacing of magnets to act as a unique key) are used to create changing flux lines. Such an embodiment may be used for a staged tool, for example, to set a packoff and open up a stage collar in one trip. A wire loop, Hall sensor, GMR sensor, or other magnetic flux sensor in the apparatus receives these signals and triggers sealing element 108 to set. In another embodiment, a wireless signal may be sent directly from the surface to the apparatus. Pressure pulses, pressure cycles, pressure profiles, tubing movement, acoustic signals, and/or EM signals may be used. The signal may be transmitted from near the surface, and optional fixed repeaters may rebroadcast the signal. A receiver on the apparatus may detect and decode the signal. The trigger may then set sealing element 108. In yet another embodiment, an acoustic signal may be sent from a downhole location. For example, an acoustic tool may be lowered from the surface and/or incorporated into the cement plug. The acoustic signals may be sent from the downhole location to the apparatus. In the case of a tool lowered from the surface, two-way communication may allow for the apparatus to acknowledge receipt of the command and tell the surface that sealing element 108 has been successfully set. In the case of an acoustic source on the cement plug, one-way communication may be used to activate sealing element 108.

While the instant disclosure describes a signal being transmitted from interior 104 of impervious body 102 to trigger the setting of sealing element 108 exterior to impervious body 102, other configurations may allow a signal to be transmitted from exterior 106 or impervious body 102 to a receiver interior to impervious body 102. For example, such configuration may be used in other tools such as a circulating valve where an annular pressure sleeve may be tripped down to move something to close a port.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. An apparatus comprising:

an impervious body configured to prevent passage of fluid therethrough;

a sealing element disposed about the impervious body;

a hydraulic fluid reservoir operationally connected to the sealing element;

an electronics compartment hydraulically connected to the hydraulic fluid reservoir;

a pressure barrier between the hydraulic fluid reservoir and the electronics compartment; and a trigger configured to receive a signal from within an interior of the impervious body and open the pressure barrier;

wherein opening of the pressure barrier permits movement of hydraulic fluid out of the hydraulic fluid reservoir and into the electronics compartment, allowing the sealing element to set.

2. The apparatus of claim 1, comprising a hydrostatic piston forming at least one boundary of the hydraulic fluid reservoir and configured to move when the pressure barrier is opened in the presence of a predetermined hydrostatic pressure;

wherein movement by the hydrostatic piston causes the sealing element to set.

3. The apparatus of claim 1, wherein the trigger is disposed between the interior and an exterior of the impervious body.

4. The apparatus of claim 1, wherein the trigger is disposed on an exterior of the impervious body.

5. The apparatus of claim 1, wherein the signal the trigger is configured to receive from within the interior of the impervious body comprises sound generated proximate a wellhead and passing through fluid passing through the interior of the impervious body, or sound generated by a pump tool passing through the interior of the impervious body.

6. The apparatus of claim 1, wherein the signal the trigger is configured to receive from within the interior of the impervious body comprises a current induced by an inductive powered device passing through the interior of the impervious body.

7. The apparatus of claim 1, wherein the signal the trigger is configured to receive from within the interior of the impervious body comprises a radio frequency identification signal generated by radio frequency devices pumped with fluid passing through the interior of the impervious body.

8. The apparatus of claim 1, wherein the signal the trigger is configured to receive from within the interior of the impervious body comprises a pH signal.

9. The apparatus of claim 1, comprising a sleeve disposed within the interior of the impervious body such that movement of the sleeve relative to the impervious body creates the signal to the trigger.

10. The apparatus of claim 9 wherein the impervious body comprises non-magnetic material; and;

wherein the signal to the trigger comprises an indication of magnetic communication between a magnet on the sleeve and a magnetic switch.

11. The apparatus of claim 9, wherein the sleeve is attached to the impervious body, and is configured to detach and move when contacted by a pump tool.

12. The apparatus of claim 1, wherein the impervious body comprises at least one joint of casing.

13. A method comprising:

providing an apparatus comprising:

an impervious body configured to prevent passage of fluid therethrough;

a sealing element disposed about the impervious body;

an energy source operationally connected to the sealing element; and a hydraulic fluid reservoir operationally connected to the sealing element;

a trigger configured to transfer energy from the energy source to the sealing element;

wherein the trigger is activated, at least in part, by receiving a signal transmitted through the impervious body;

wherein opening of the pressure barrier permits movement of hydraulic fluid out of the hydraulic fluid reservoir and into the electronics compartment, allowing the sealing element to set;

introducing the apparatus into a wellbore; and providing the signal to the trigger through the impervious body, thereby causing the sealing element to set.

14. The method of claim 13, comprising allowing a predetermined time to elapse after providing the signal to the trigger and before the trigger causes the sealing element to set.

15. The method of claim 13, comprising, after introducing the apparatus into the wellbore, introducing a signal generating device into the wellbore, so as to provide a signal to the trigger.

16. The method of claim 15, wherein the signal generated by the signal generating device is selected from the group consisting of transmission or modification of sound, transmission or modification of a magnetic signal, transmission or modification of an induced current, transmission or modification of vibration, transmission or modification of a thermal signal, transmission or modification of magnetic permeability, transmission or modification of dielectric permittivity, transmission or modification of radio frequency, and transmission or modification of a signal relating to strain.

17. An apparatus comprising:

an impervious body configured to prevent passage of fluid therethrough;

a sealing element disposed about the impervious body;

a hydraulic fluid reservoir operationally connected to the sealing element;

an electronics compartment hydraulically connected to the hydraulic fluid reservoir;

a pressure barrier between the hydraulic fluid reservoir and the electronics compartment; and a trigger configured to receive a signal from within an interior of the impervious body and open the pressure barrier;

a sleeve disposed within the interior of the impervious body such that movement of the sleeve relative to the impervious body creates the signal to the trigger;

wherein opening of the pressure barrier permits movement of hydraulic fluid out of the hydraulic fluid reservoir and into the electronics compartment, allowing the sealing element to set.

* * * * *